United States Patent [19]

Ochiai

[11] Patent Number: 4,761,305

[45] Date of Patent: Aug. 2, 1988

[54] METHOD FOR FINISHING CLOTHES

[76] Inventor: Hiromichi Ochiai, No. 1-28-5, Kakinokizaka, Meguro-ku, Tokyo, Japan

[21] Appl. No.: 93,705

[22] Filed: Sep. 8, 1987

[30] Foreign Application Priority Data

Sep. 12, 1986 [JP] Japan ..... 61-215304

[51] Int. Cl.[4] ..... B05D 1/12

[52] U.S. Cl. ..... 427/180; 427/315; 427/323; 427/389.9; 427/426; 68/5 C

[58] Field of Search ..... 427/426, 421, 180, 315, 427/323, 389.9; 68/5 C, 149.3; 6/137, 142

[56] References Cited

U.S. PATENT DOCUMENTS 4,391,602 7/1983 Stichnoth et al. .

4,519,222 5/1985 Kannegiesser et al. ..... 68/5 C 4,643,919 2/1987 Fu ..... 427/389.9

*Primary Examiner*—Shrive P. Beck

*Attorney, Agent, or Firm*—Parkhurst & Oliff

[57] ABSTRACT

A method for finishing clothes, that improves the wearing sensation and feeling of the clothes on the body, consisting of arranging one or more articles of clothing by hanging from a rod in a sealed chamber after dry cleaning or washing the clothes, then spraying hydrophilic finishing agent which is water soluble or diluted with water by emulsifying in a predetermined quantity adapted for the clothes to be finished to moisten the entire front and back surfaces of the clothes to be finished by adhering the agent thereto, thereafter or simultaneously therewith the clothes are fully steamed. Then blowing hot air upon the clothes to dry them. This method can (1) use any finishing agent which is water soluble or that can be diluted with water by emulsifying, (2) uniformly adhere or impregnate finishing agent to all outer and inner surfaces of clothes, (3) perform spraying of a predetermined quantity of finishing agent in a short working time span of seconds and (4) reduce facility costs.

7 Claims, 1 Drawing Sheet

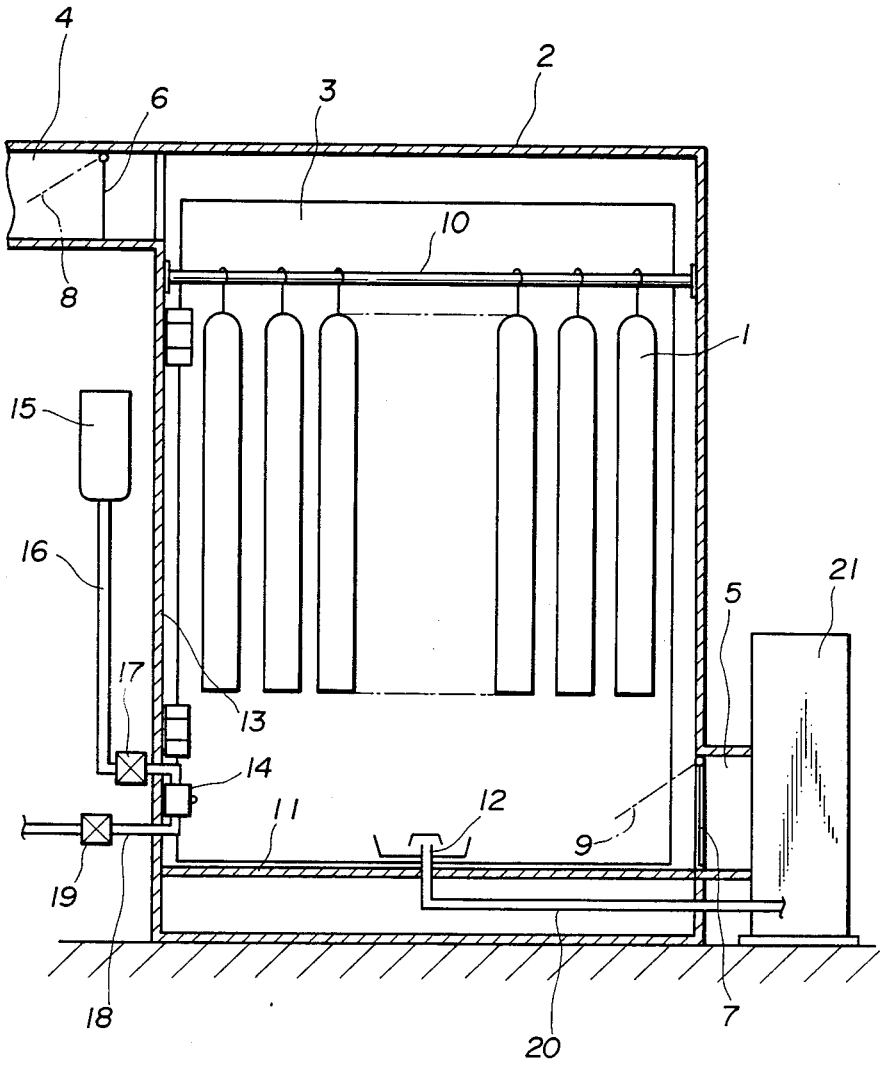
4
6
3
2
10
8
1
15
16
21
5
17
13
14
12
11
9
19
18
20
7

METHOD FOR FINISHING CLOTHES

BACKGROUND OF THE INVENTION

This invention relates to an improvement in a method for finishing clothes after being dry cleaned or washed to improve the wearing sensation and feeling of the clothes as well as their luster, smoothness, suppleness and fluffiness.

In the conventional finishing method, after clothes which are mainly made of animal hair such as wool are cleaned and dried, or after clothes which are made of blended yarn fabric of vegetable fiber and synthetic fiber (polyester, nylon etc.) are washed and dried, the clothes are hung from a rod in a sealed chamber, and moistened with steam to utilize the steam plasticity of protein fiber or synthetic fiber, thereby smoothing the wrinkles of the clothes. Hitherto, the finishing agent was sprayed on the clothes in advance by a manual trigger sprayer out of the sealed chamber or sprayed by a sprayer in a rotary drying machine for drying the clothes. The clothes were hung in a sealed chamber after spraying them in the conventional method. Recently, a new method has been developed whereby the finishing agent is supplied together with steam. In this method the finishing agent is injected in a pipe for feeding steam into the sealed chamber where it is vaporized by the steam and the resulting mixed vapor is then fed into the chamber.

The conventional method of spraying the agent outside of the sealed chamber by a manual trigger sprayer employs an ordinary pressure type sprayer nozzle which is generally sold in the market and which sprays particles of agent of approx. at least 100 microns in size. The drawback of this method is that particles of this size remain adhered to the outer surfaces of the clothes to be finished in a moistened state, and the agent does not penetrate to the inside or back surfaces of the clothes.

The method for adhering the agent to the clothes by spraying in a rotary drying machine allows the agent to adhere to the front and back surfaces of the clothes. The drawbacks to this method are that it requires the use of a separate rotary drying machine or dry cleaning machine having a rotary drying drum and that it uses an ordinary pressure type sprayer that sprays particles of agent 100 microns or more in size which adhere irregularly to the clothes.

The method for vaporizing the finishing agent by injecting it in the steam pipe is restricted to finishing agents that can be vaporized by steam, and accordingly the drawback to this method is that the types of finishing agents that can be used in this method are very limited.

SUMMARY OF THE INVENTION

Accordingly, the objective of the subject invention is to provide a method for finishing clothes which improves the wearing sensation and feeling of the clothes on the body and eliminates the above-mentioned drawbacks and disadvantages. This method can (1) use any finishing agents which are water soluble or that can be diluted with water by emulsifying, (2) uniformly adhere or impregnate finishing agent to all outer and inner surfaces of the clothes, (3) perform spraying of the agent of a predetermined quantity in a short time span of seconds, and (4) reduce facility costs.

In order to achieve the above objective, the subject invention provides a method for finishing clothes comprising of arranging one or more articles of clothing to be finished by hanging them from a rod in a sealed chamber after dry cleaning or washing the clothes, then spraying fine particles of 10 to 60 microns of hydrophilic finishing agent which is water soluble or diluted with water by emulsifying in a predetermined quantity adapted for the clothes to be finished, to moisten the entire front and back surfaces of the clothes to be finished by adhering the agent thereto. Thereafter or simultaneously therewith the clothes are fully steamed, and then blown with hot air.

According to the inventor's research, when the particles of the finishing agent are within a range of 10 to 60 microns, the particles carried in the air stream penetrate minutely into the inner and outer surfaces of the clothes to be adhered, and the finishing agent can be readily atomized by an air atomizing nozzle which is sold in the market. Particles within a range of 20 to 50 microns are preferable to penetrate minutely the inner and outer surfaces of the clothes to be adhered and the spraying of the finishing agent is completed in a short time span.

If the particles of finishing agent are less than 10 microns, the spraying takes a long time and is therefore inefficient and if larger than 60 microns, the outer surfaces of the clothes remain moist, thereby rendering it difficult to carry the agent in the air stream to minutely penetrate to the inside of the clothes.

Under the present method, the finishing agent is sprayed in fine particles within a range of 10 to 60 microns. These fine particles are carried in the air stream and readily introduced not only to the outer surfaces of the clothes to be finished, but also are to minutely introduced to the inside of the clothes. Thereby the agent uniformly adheres to and impregnates the inner and outer surfaces of the clothes.

Further, the spraying of the agent in fine particles of approx. 10 to 60 microns can be readily achieved in a short time by using an air atomizing nozzle utilizing high pressure air. This air atomizing nozzle is used together with a finishing agent supplying pipe and a high pressure air supplying pipe as combined facilities, thereby shortening the predetermined working time and reducing costs. In addition, since the clothes are moistened with steam while in the state where the finishing agent has uniformly adhered to and impregnated the inner and outer surfaces of the clothes to be finished, the wrinkles on the clothes can be almost fully removed and the soft touch and feel of new fabric can be achieved.

The above and other related objectives and features of the present invention will be apparent from a reading of the following description and the accompanying drawing and the novelty thereof is pointed out in the appended claims.

BRIEF DESCRIPTION OF THE DRAWINGS

The drawing is a schematic vertical sectional view of an example of the apparatus used for performing the method for finishing clothes according to the present invention.

DESCRIPTION OF THE PREFERRED EMBODIMENTS

This invention will now be described in detail with reference to the drawing, which shows an example of an apparatus used for performing the method for finishing clothes under the subject invention. This apparatus is constructed in a structure that is a sealed chamber 2 used to finish clothes 1 to be finished. The chamber 2 has two ducts, an exhaust duct 4 and a hot air blowing duct 5, and closing door 3. The exhaust duct 4 and the hot air blowing duct 5 are always closed by dampers 6, 7 by springs, and the dampers 6, 7 are opened by the dynamic pressure of the hot air when it is blown as described later, designated by dotted lines in the drawing.

A rod 10 for hanging the clothes 1 to be finished is fixed in the upper portion of the sealed chamber 2, a steam injector 12 is installed in the floor 11, an air atomizing nozzle 14 (described later) is affixed to the lower portion of an inner wall 13. The nozzle 14 is connected to a finishing agent tank 15, which contains water soluble or hydrophilic finishing agent to be diluted with water. The tank 15 is connected via an agent supplying pipe 16 provided with a solenoid valve 17 to the nozzle 14, to which a high pressure air supplying pipe 18 provided with a solenoid valve 19 is also connected.

The steam injector 12 is connected to a steam generating boiler (not shown) via a pipe 20. The exhaust duct 4 is opened at the upper portion of the sealed chamber 2, and the hot air blowing duct 5 is opened at the inner wall near the floor 11 and connected to a hot air generator 21.

The air atomizing nozzle 14 employs a flat spray, set-up No. F2C made by Spraying Systems Japan Co..

In the apparatus as shown in the drawing, the sealed chamber 2 was constructed having dimensions of 60 cm in width, 60 cm in depth and 180 cm in height. 5 kg of wool suits were hung therein, and 20 g of water soluble softening finisher, for example, mainly containing a surfactant as the finishing agent was filled for one use into the finishing agent tank 15. The sealed chamber 2 was then sealed, the finishing agent was fed through the agent supplying pipe 16, and compressed air of 2 $kg/cm^2$ was simultaneously supplied through the high pressure air supplying pipe 18 to the air atomizing nozzle 14, and the water soluble softening finishing agent in the amount used for one finishing step was completely sprayed within approx. 20 sec. It was verified that fine particles of the finishing agent within a range of 20 to 50 microns were sprayed from the air atomizing nozzle 14 of the type described above.

After the above-mentioned spraying was completed, the sealed chamber was allowed to stand for approx. 20 sec. so that the processing time with the finishing agent took a total of 40 sec. The quantity of finishing agent which effectively adheres to the clothes is approx. 50 % of the amount of sprayed finishing agent.

Steam (1 $kg/cm^2$ to 2 $kg/cm^2$) of 110° to 120° was then injected from the steam injector 12 having several openings of approx. 2 mm in diameter perforated at the end thereof in the same way as the conventional method for 30 sec., and after the injection was completed, the sealed chamber was further allowed to stand for 20 sec., thereby allowing the clothes to become moistened with the steam. The dampers 6, 7 still remained closed by the internal pressure in the sealed chamber 2 to this stage.

Then, hot air of approx. 80° C. was blown from the hot air generator 21 through the hot air blowing duct 5 into the sealed chamber 2 for 60 sec. The pressure of hot air was 15 to 20 $mmH_2O$, and the quantity of air was approx., 20 $m^3$/min. At this time, the dampers 6,7 were opened by the dynamic pressure of the hot air, and the hot air and the moisture which evaporated from the clothes were exhausted from the exhaust duct 4. After the blowing of the hot air was finished, normal temperature air was then blown through the hot air blowing duct 5 for 30 sec. to cool the clothes to be finished.

The spraying of the finishing agent was completed during the above-described process After the clothes were allowed to stand for 20 sec., the clothes were inspected and found to be entirely uniformly moistened with the finishing agent over both the inner and outer surfaces thereof.

The clothes removed from the sealed chamber 2 after cooling have the original softness and suppleness of wool, and finished with a preferable soft touch and feel from which wrinkles are removed.

After more clothes to be finished are placed in the sealed chamber, the above-described operations are automatically repeated.

In the process described above, a steam cabinet was used as the sealed chamber. However, the subject invention is not limited to this particular facility. For example, the sealed chamber may employ a so-called steam tunnel finisher. In this case, the clothes to be finished are finished by the method according to the subject invention while the clothes are continuously fed through the steam tunnel finisher.

In the process described above, one air atomizing nozzle was used. However, a number of air atomizing nozzles may also be used within the scope of the subject invention. The mounting positions and the number of the nozzles are determined so that the finishing agent may sufficiently impregnate both the front and back surfaces of the clothes. When the sealed chamber is of the steam tunnel finisher type, the speed of feeding of the clothes by a conveyor mechanism, the distance between the clothes hung by hangers, and the size of the steam chamber are determined as required.

The finishing agent used in the method of the subject invention is a water soluble type or hydrophilic type such as emulsion type suspended in water as ultrafine particles. For example, softeners of silicon polymer finishing agent, glycol polymer finishing agent, and cationic surfactant are usually employed. The concentration of the agent depends upon the type of agent used. If its viscosity is considerably large, it cannot be effectively sprayed, and an aqueous solution of suitable concentrations is employed. Since the effective adhering quantity of the agent to the clothes by spraying is approx. 50%, the required quantity of the agent is determined by this. When the finishing agent is silicon polymer finishing agent, the effective adhering quantity of the agent is approx. 0.2% of the total weight of the clothes placed in the sealed chamber. The least effective adhering quantity of the agent may also be approx. 0.02% of the total weight of the clothes placed in the sealed chamber.

The time required for spraying the agent is determined by the quantity of the agent. When using the air atomizing nozzle, approx. 1 cc per 1 sec. of the agent may be sprayed as ultrafine particles of 10 to 80 microns. The spraying time is variably selected according to the clothes to be finished, and can be set in a controller. The spraying time of the agent is preferably approx. 20 sec. when the time for performing the finishing is approx. 3 min. under the subject invention.

In the process described above, the steam has been injected after the finishing agent has been completely sprayed. However, the subject invention is not limited to this particular process. For example, the agent may be sprayed simultaneously during injection of the steam, or may also be sprayed immediately after injection of the steam. In summary, the finishing agent may be applied to the clothes to be finished in the step of moistening the clothes which is performed after the steam is injected.

Under the present invention, a hydrophilic finishing agent capable of being water soluble or diluted with water may be used, even if its vaporization is impossible, so the available range of finishing agents for clothes is greatly increased. There are additional provided advantages of spraying the finishing agent, the inner and outer surfaces of the clothes in the sealed chamber are uniformly adhered and impregnated with the agent so as to remarkably improve the soft touch and feel of the clothes. Further, the other provided advantages are that the finishing agent can be sprayed in a short working time span of seconds by the use of an air atomizing nozzle which may be installed in the facility to finish the clothes in superior quality without extending the working time or the facility costs.

What is claimed under the subject invention:

1. A method for finishing clothes that improves the wearing sensation and feeling of the clothes on the body comprising of the steps of:

arranging one or more articles of clothing to be finished by hanging them from a rod in a sealed chamber used for finishing after dry cleaning or washing the clothes;

then spraying fine particles of 10 to 60 microns in diameter of a hydrophilic finishing agent which is water soluble or dilutes with water by emulsifying, in a predetermined quantity adapted for the clothes to be finished, to moisten the entire front and back surfaces of the clothes to be finished by adhering the agent thereto; and thereafter or simultaneously therewith steaming the clothes, then blowing with hot air to dry them.

2. The method according to claim 1, wherein the hydrophilic finishing agent is sprayed as fine particles of 20 to 50 microns in diameter.

3. The method according to claim 1, wherein the hydrophilic finishing agent is silicon polymer finishing agent.

4. The method according to claim 1, wherein the hydrophilic finishing agent is glycol polymer finishing agent.

5. The method according to claim 1, wherein the hydrophilic finishing agent is a softener, mainly of cationic surfactant.

6. The method according to claim 1, wherein said sealed chamber is a steam cabinet finisher.

7. The method according to claim 1, wherein said sealed chamber is a steam tunnel finisher.

* * * * *